US009648678B1

(12) United States Patent
Xiong et al.

(10) Patent No.: US 9,648,678 B1
(45) Date of Patent: May 9, 2017

(54) LED DRIVER CIRCUIT WITH DIMMING CONTROL AND PROGRAMMING INTERFACES

(71) Applicant: Universal Lighting Technologies, Inc., Madison, AL (US)

(72) Inventors: Wei Xiong, Madison, AL (US); John J. Dernovsek, Madison, AL (US); Takeshi Goriki, Kyoto (JP)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 0 days.

(21) Appl. No.: 14/852,798

(22) Filed: Sep. 14, 2015

Related U.S. Application Data

(60) Provisional application No. 62/049,647, filed on Sep. 12, 2014.

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0839; H05B 33/0845
See application file for complete search history.

(56) References Cited

U.S. PATENT DOCUMENTS

| | | | | |
|---|---|---|---|---|
| 8,928,236 | B1 * | 1/2015 | Mays, II | H05B 33/0848 315/200 R |
| 9,125,259 | B1 * | 9/2015 | Xiong | H05B 33/0815 |
| 9,414,457 | B2 * | 8/2016 | Fukuda | H05B 33/0857 |
| 2012/0286681 | A1 * | 11/2012 | Hausman, Jr. | H05B 41/2828 315/200 R |
| 2014/0285109 | A1 * | 9/2014 | Liao | H05B 33/0815 315/291 |
| 2015/0230303 | A1 * | 8/2015 | Gong | H05B 33/0815 315/224 |
| 2015/0264755 | A1 * | 9/2015 | Hsia | H05B 33/0815 315/294 |

* cited by examiner

*Primary Examiner* — Alexander H Taningco
*Assistant Examiner* — Kurtis R Bahr
(74) *Attorney, Agent, or Firm* — Patterson Intellectual Property Law, PC; Mark J. Patterson; Grant M. Ford

(57) ABSTRACT

An LED driver circuit is provided with a dynamic operating range. A controller for a power converter is configured to regulate the output voltage and the output current generated by the power converter based on a dimming control signal from a dimming control interface, a sensed output from the power converter, and programmed maximum output voltage and maximum output current values. The tuning interface may be coupled to the dimming control interface and provide a sequence of digital pulses corresponding to a desired maximum output voltage and/or maximum output current. The controller may modify the programmed maximum output voltage and the maximum output current values based on the predetermined sequence of digital pulses received via the tuning interface circuit.

18 Claims, 8 Drawing Sheets

500

LED DRIVER CIRCUIT WITH DIMMING CONTROL AND PROGRAMMING INTERFACES

CROSS-REFERENCES TO RELATED APPLICATIONS

This application claims benefit of U.S. Provisional Patent Application No. 62/049,647, dated Sep. 12, 2014, and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to circuitry and methods for powering a light source such as an LED load. More particularly, the present invention relates to methods for dynamic adjustment of power parameters for LED drivers.

Light emitting diode ("LED") lighting is growing in popularity due to decreasing costs and long life compared to incandescent lighting and fluorescent lighting. LED lighting can also be dimmed without impairing the useful life of the LED light source.

LED loads are DC current driven, so a DC-DC or AC-DC converter is needed to regulate the current going through the LED in order to control the output power and luminance. An exemplary dimmable LED driver 10 is represented in FIG. 1. As shown, a typical four-wire output 0-10 v controllable AC-DC converter 14 is positioned between the AC mains input 12 and the LED load 16. This AC-DC converter regulates the DC current going through the LED lighting module and also receives control signals from dimming control block 18 in order to set the output current dynamically. Typically, a DC voltage 20 is provided as the input of the dimming control block 18. The dimming control block will sense the voltage level 20 (e.g., V_control) and set the control signal 22 for the reference of LED output current according to a preset relationship between the two values 20, 22.

The output range of the LED driver as shown in FIG. 1 typically is limited with values for a maximum output voltage (Vout_max) and maximum output current (I_out_max) as are associated with a maximum output power for the particular LED driver design, which means that there is only one maximum output current and one maximum voltage for this driver in steady state operation.

An exemplary operating range for this type of LED driver is shown in FIG. 2, wherein the operating area is limited to the highlighted region as further defined by a maximum current (I_max), minimum current (I_min) and maximum voltage (Vmax). When the output current changes the maximum output voltage would remain the same.

BRIEF SUMMARY OF THE INVENTION

One objective of systems and methods as disclosed herein is to consolidate a series of LED drivers into a single driver that has an adjustable output. For example, it would be desirable to consolidate these 5 LED drivers into one single 80 W LED driver: 2 A-40V-80 W; 1.5 A-53V-80 W; 1 A-80V-80 W; 0.73 A-109V-80 W; and 0.53 A-151V-80 W. Such a design for an LED driver circuit or a light fixture incorporating such a circuit would accordingly save development time, cost, and storage room.

LED driver circuit designs as disclosed herein are provided to combine the dimming interface and LED output tuning interface so that the operating range of the LED driver could be dynamically tuned.

LED driver circuit designs as disclosed herein are provided to combine the dimming interface and LED output tuning interface so that the driver would have a constant power type operation range.

In one exemplary embodiment of an LED driver circuit as disclosed herein, an LED driver circuit for powering an LED array, the LED driver may include a power converter. The power converter may be configured to generate an output voltage and an output current for driving the LED array. The LED driver may further include a dimming interface circuit configured to generate a dimming control signal based on an input received across first and second dimming input terminals. The LED driver may further include a tuning interface circuit which is configured to removably couple to the first and second dimming input terminals and to provide a programming signal associated with at least one of the output voltage and the output current. The LED driver may also include a controller configured to regulate the output voltage and the output current generated by the power converter, based on the dimming control signal, a sensed output from the power converter, and at least one of a programmed maximum output voltage and a maximum output current value associated with the power converter, the dimming interface circuit, and the tuning interface circuit.

In another exemplary aspect of the present disclosure, a method of dynamically adjusting power parameters for an LED driver circuit is provided. The LED driver circuit may include a power converter configured to generate an output voltage and an output current, a dimming interface circuit having first and second input terminals, and a controller configured to regulate operation of the power converter based on the dimming control signal, a sensed output from the power converter, and at least one of a programmed maximum output voltage and a programmed maximum output current value associated with the power converter, dimming interface circuit, tuning interface circuit, and the controller.

The method may include first coupling a tuning interface circuit across the first and second input terminals of the dimming interface circuit, generating a predetermined sequence of digital pulses from the tuning interface circuit, the sequence of digital pulses corresponding to at least one of a target maximum output voltage and a target maximum output current, decoding the sequence of digital pulses to identify the target values, and modifying at least one of the programmed maximum output voltage and the programmed maximum output current values to correspond to at least one of the target maximum output voltage and the target maximum output current value.

In another exemplary aspect of the system, a method of dynamically adjusting maximum power parameters for a light fixture is provided. The light fixture may include an AC-DC power converter configured to couple to an AC power source, an LED array coupled across first and second outputs from the AC-DC power converter, a dimming interface circuit having first and second input terminals, and a controller configured to regulate operation of the power converter based on a dimming control signal, a sensed output from the power converter, and at least one of a programmed maximum output voltage value and a maximum output current value.

The method may include coupling a programming interface circuit across the first and second input terminals of the dimming interface circuit, generating a predetermined sequence of digital pulses from the programming interface circuit, the sequence of digital pulses corresponding to at least one of a target maximum output voltage and a target maximum output current, decoding the sequence of digital pulses to identify at least one of the target maximum output voltage and the target maximum output current values, and modifying at least one of the programmed maximum output voltage and the programmed maximum output current values to correspond to at least one of the target maximum output voltage and the target maximum output current values.

In still further exemplary aspects of the system, the controller may identify a target maximum output voltage based on a predetermined sequence of digital pulses received via the tuning interface circuit, and modify the programmed maximum output current and the programmed maximum output voltage based on the identified target maximum output voltage and a programmed constant power for the power converter. Alternatively, the controller may identify a target maximum output current based on a predetermined sequence of digital pulses received via the tuning interface circuit, and further modify the programmed maximum output current and the programmed maximum output voltage based on the target maximum output current and a programmed constant power for the power converter.

DETAILED DESCRIPTION OF THE INVENTION

Figure 1:
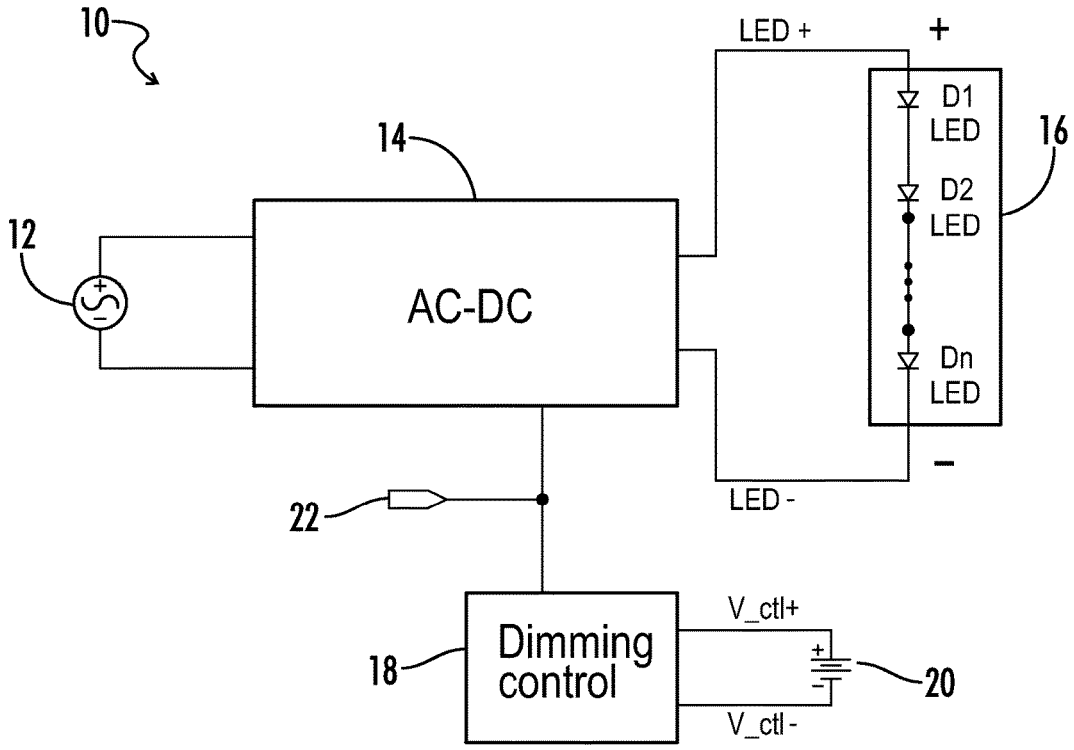
FIG. 1 (PRIOR ART)
FIG. 1 is a block diagram representing a conventional dimmable LED driver circuit.
Figure 2:
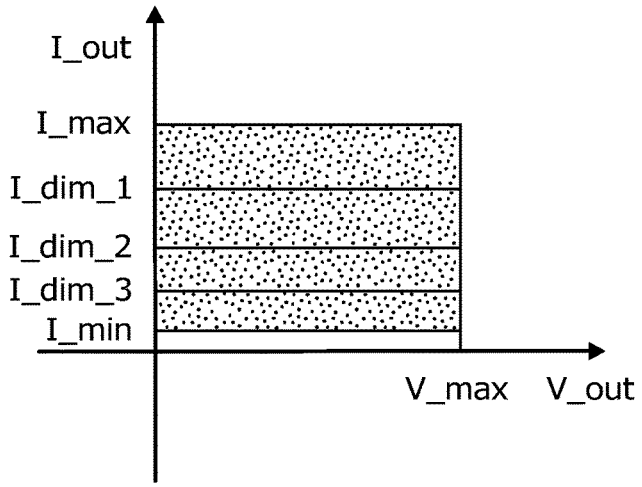
FIG. 2 is a graphical plot representing a conventional operating range for the LED driver circuit of FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 3-10, an LED driver and associated methods according to the present disclosure are now illustrated in greater detail. Where the various figures may describe embodiments sharing various common elements and features with other embodiments, similar elements and features are given the same reference numerals and redundant description thereof may be omitted below.

Various embodiments of an LED driver according to the present disclosure may be designed in order to drive LED lighting elements with constant power. Embodiments of an LED driver may further be designed such that an output voltage maximum limit and/or output current maximum limit may be dynamically adjusted. The LED driver, associated circuitry and methods as presented in this disclosure further address the stated objective of consolidation.

Figure 3:
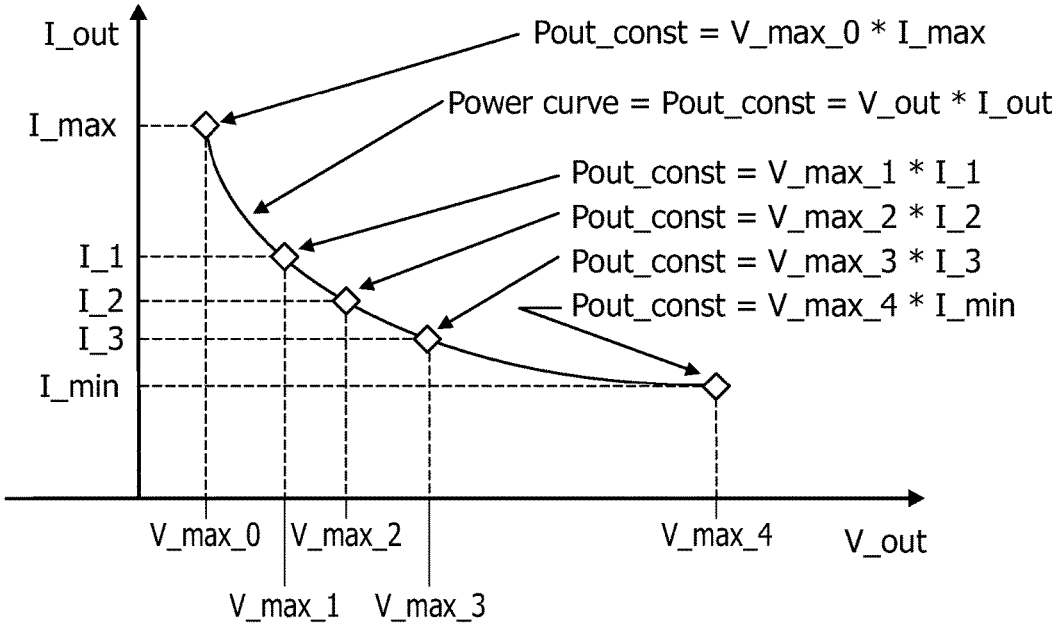
FIG. 3 is a graphical plot representing an exemplary operating range for an LED driver circuit according to the present disclosure.

In various exemplary embodiments, an output operating range may be controlled under a characteristic constant power curve, as represented for example in FIG. 3. The dynamic operating range will be limited by the constant power curve Power curve=Pout_const=V_out*I_out. For each preset LED output current, there is a special operating range according to the output voltage V_out=Pout_const/I_out. For example: I_max & V_max_0; I_1 & V_max_1; I_2 & V_max_2; I_3 & V_max_3; and I_min & V_max_4.

Figure 4:
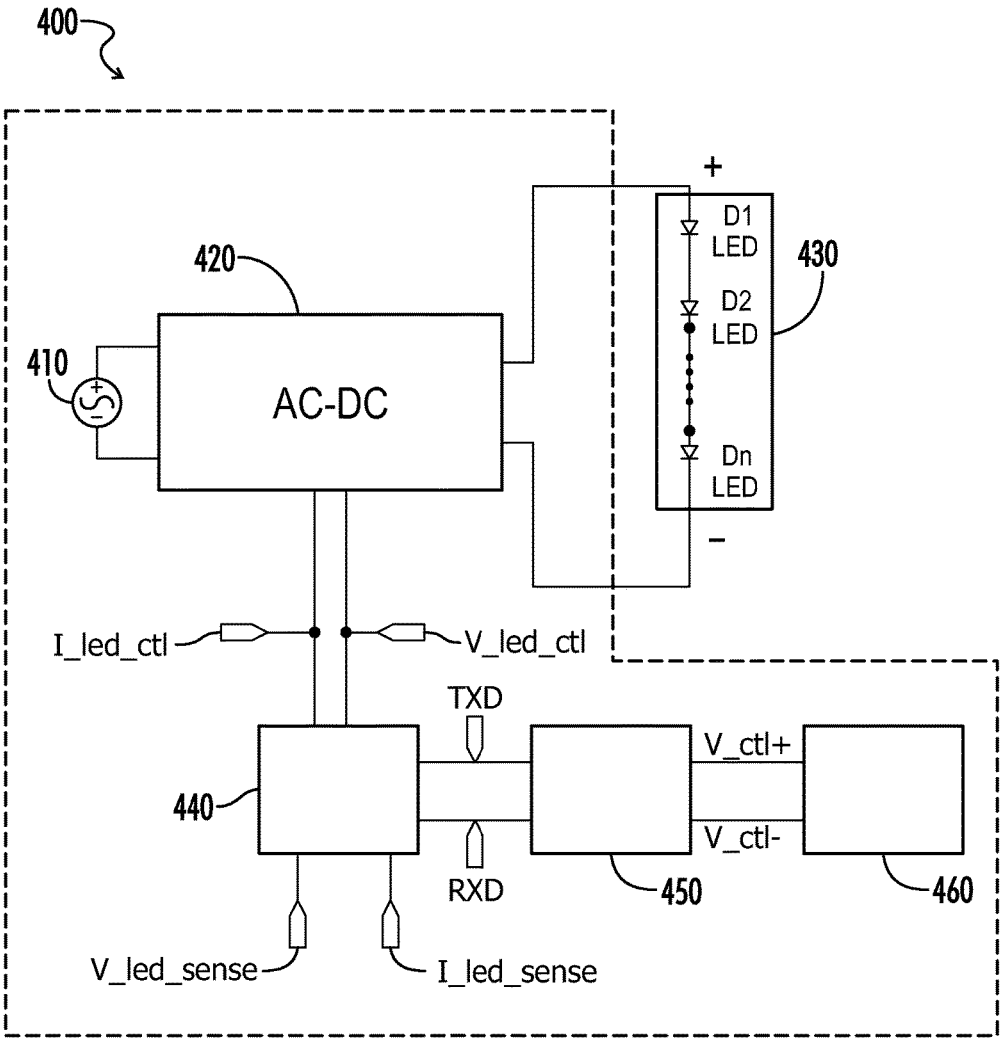
FIG. 4 is a block diagram and partial schematic diagram representing an exemplary embodiment of an LED driver according to the present disclosure.

Referring to FIG. 4, an LED driver 400 according to an exemplary embodiment is illustrated. LED driver may comprise a power source 410 connected to an AC-DC converter 420. The AC-DC converter 420 may receive a LED current control signal I_led_ctl and/or LED voltage control signal V_led_ctl to dynamically control an output current and/or voltage. An output of the AC-DC Converter 420 may be connected to and drive an LED load 430 comprising one or more LEDs D1 LED, D2 LED, . . . , Dn LED. The AC-DC Converter 420 may be connected to a microcontroller 440 in one embodiment. The microcontroller 440 may connect to a dimming and range setting block 450, which may be used to sense a dimming control signal and range setting signal. The microcontroller 440 may be used to decode a signal coming from the dimming and range setting block 450 to dim the output and dynamically change the output current and voltage setting to maintain a constant output power feature.

In one embodiment, a DC voltage source may be connected between V_ctl+ and V_ctl− for dimming control at block 460. A programmer 460 (e.g., a pulse signal programmer) may be connected between V_ctl+ and V_ctl− for setting or manipulating an LED voltage and current. The programmer 460 may send out a coded digital signal to the dimming and range setting block 450 and the microprocessor 440 to dynamically set output current and voltage parameters stored in the microprocessor 440. The microprocessor 440 may be configured in one embodiment to transmit a confirm signal back to the programmer 460 to confirm a change. In one embodiment, a signal TXD may comprise a confirming command signal sent to the programmer 460 to generate the confirm signal. A signal RXD may be configured to be received by the microcontroller 440 to sense an operation corresponding to a voltage level associated with the dimming and range setting block 450.

Figure 5:
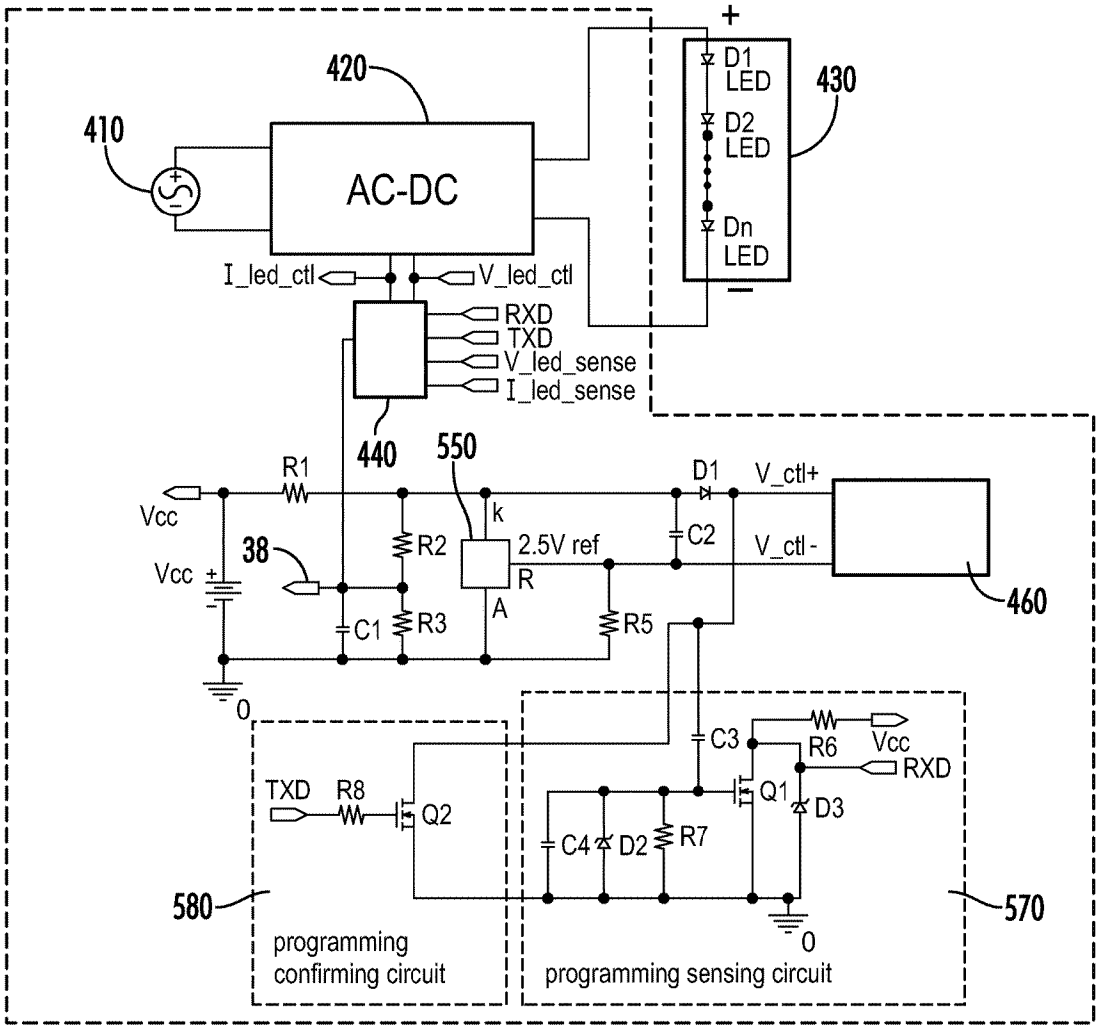
FIG. 5 is a block diagram of an exemplary internal circuitry for an LED driver in accordance with the present disclosure.
Figure 6:
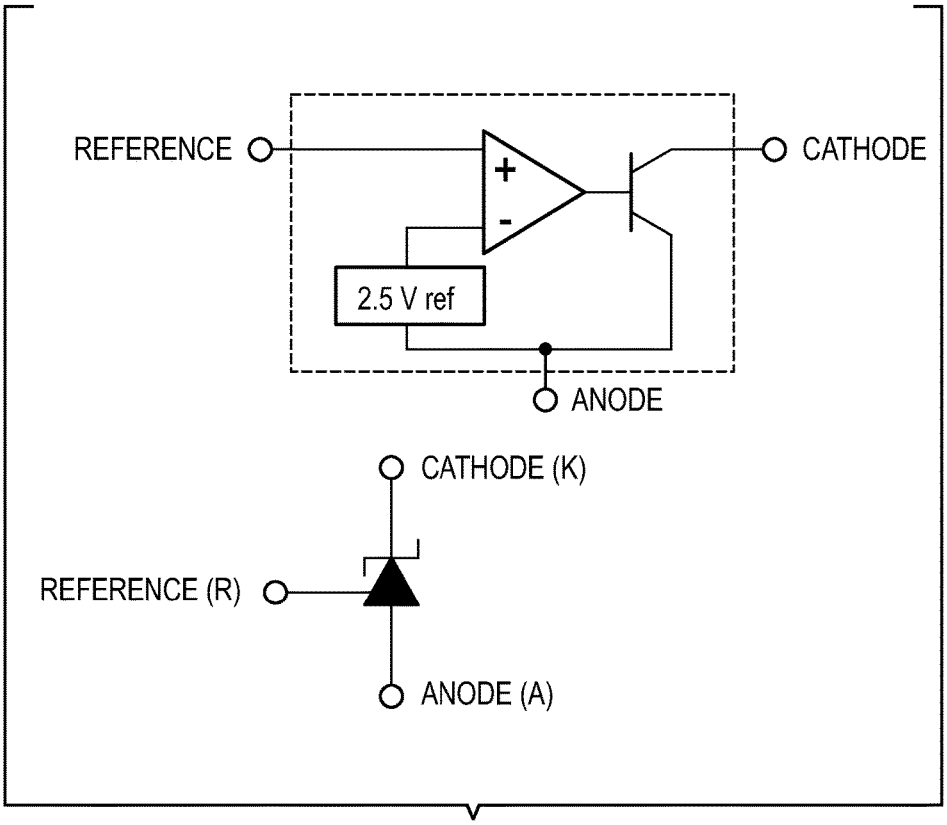
FIG. 6 is a block diagram and partial schematic diagram representing an exemplary programmable shunt regulator.

Referring to FIG. 5, an LED driver 500 according to an exemplary embodiment is provided. The LED driver 500 may comprise a power source 410, AC-DC converter 420, and may be connected to an LED load 430 as illustrated at FIG. 4 and as previously described. The LED driver 500 may for example comprise a microprocessor 440. A programmable shunt regulator 550 may be used for dimming control. In one embodiment, the programmable shunt regulator 550 may comprise a TL431 model programmable shunt regulator. An internal block diagram corresponding to an exemplary programmable shunt regulator (e.g., TL431) is illustrated by FIG. 6. In the programmable shunt regulator 550 illustrated at FIG. 6, the "A" terminal is the ground reference, K is the input of the regulator, and R is the reference voltage. Resistor R5 may be connected between R and A to set the maximum output current that is allowed through V_ctl+ and V_ctl−. The maximum current may, in one embodiment, be defined by 2.5V/R5. However, a maximum current associated with the AC-DC converter 420 may vary based upon a particular circuit configuration or characteristic of the circuit or component.

Capacitor C2 may be used to filter out high frequency noise in one embodiment. Diode D1 may be used to force the current to go only through V_ctl+ and V_ctl− and to block negative voltage across V_ctl+ and V_ctl−. Resistor R1 may be used to limit the current going into the programmable shunt regulator 550. Resistors R2 and R3 may be configured to form a voltage divider to sense a dimming signal that is controlled by the voltage across V_ctl+ and V_ctl−. The voltage across R2 and R3 may be defined by the equation: V_r2_r3=0.7V+2.5V+V_ctl.

The dim_sense voltage 38 may, in one embodiment, follow the equation: V_dim_sense=(0.7V+2.5V+V_ctl.) *R2/(R2+R3). As a result, the dim sense voltage may be linearly proportional to the dimming control voltage V_ctl in one implementation. The microcontroller 440 may sense the dimming control signal and set the LED current output dynamically by changing signal I_led_ctl.

Capacitor C3 in FIG. 5 may be used to sense a dv/dt change to charge or discharge the gate to source capacitor C4 to turn on or turn off Mosfet Q1. D2 may be used to limit the voltage across C4. Resistor R7 may be used for noise suppression. Resistor R6 may be connected between Vcc and the drain of Q1. Thus, when Q1 is off the voltage at RXD is a high (1) voltage that may be limited by diode D3. When Q1 is on, RXD is in a low state (0).

A tuning program sensing circuit 570 may be coupled via capacitor C3 to the second dimming interface terminal V_ctl+. The capacitor C3 may be configured to sense a transient change in voltage over time dv/dt to charge or discharge the gate-source capacitor C4 and subsequently turn on or turn off a switching element Q1 coupled thereto. The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

When a programmer 460 is used to reset a current and/or voltage parameter, a series of digital signals is generated by the programmer 460 across V_ctl+ and V_ctl−. Tuning program sensing circuit 570 may be configured to generate a series RXD signal and to feed back to the microprocessor 440 for setting an output voltage and/or current.

Figure 7:
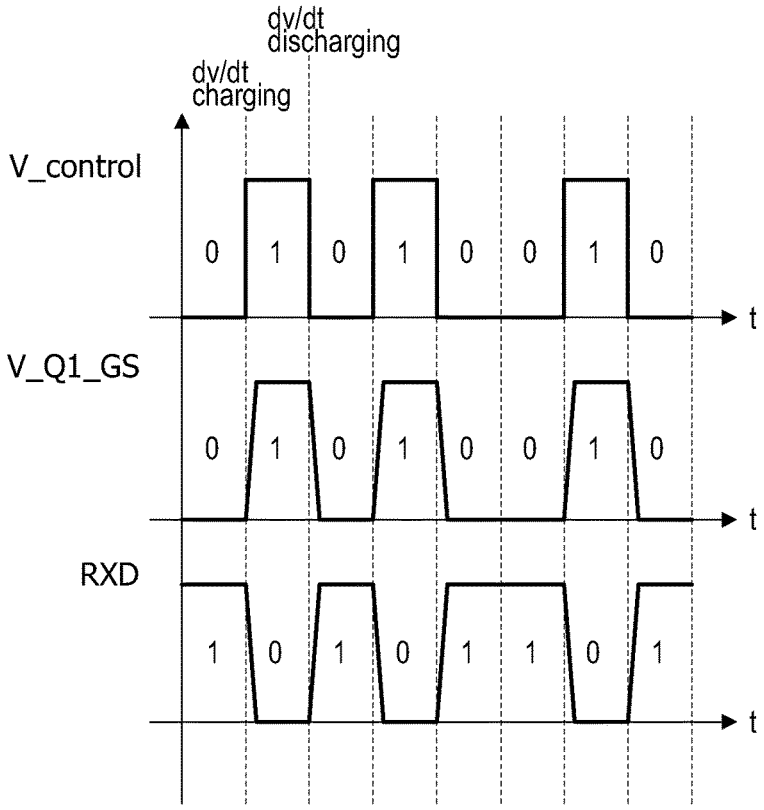
FIG. 7 is a graphical plot representing an exemplary working principle of a tuning interface sensing circuit according to the LED driver of FIG. 5.

Further illustration of this is provided with reference now to FIG. 7. When the programmer 460 is used to set a maximum output voltage and/or maximum output current value, a series of high (1) and low (0) digital pulses may be sent out across V_ctl+ and V_ctl−. In one embodiment, a voltage measured across V_ctl+ and V_ctl− received from a programmer 460 or received DC dimming control signal may be referred to as V_control. As V_control changes from low (0) to high (1), a positive transient dv/dt takes place. The capacitor C3 may sense this positive transient dv/dt to a charging current through the gate electrode to the source electrode of switching element Q1, charging up the gate-source capacitor C4 as a result. A gate-source voltage for the switching element Q1 is charged up to high and turns on the switching element Q1, and as a result the digital signal output RXD will be low (0) after the 0-1 transient. After V_control changes to high (1), it will stay steady at high (1) for a short period of time. Since there is no transient dv/dt when the control voltage is stable, there is no current that charges or discharges the gate-source voltage of the switching element Q1. Therefore the gate-source voltage V_Q1_GS of the switching element Q1 will stay high (1) after the 0-1 transient of V_control.

When the next transient of V_control occurs, V_control may change from high (1) to low (0), which introduces a detectable negative transient dv/dt at the capacitor C3 and discharges the gate-source capacitor C4 to zero. The gate-source voltage V_Q1_GS of the switching element Q1 will remain 0 when V_control remains low (0). As a result, the digital signal output RXD will be reversed as compared to V_control. The microcontroller 440 will accordingly sense the digital signal RXD, and in various embodiments may be configured to perform a logic inverse to obtain the same signal as V_control. Where specific signal sequences have been pre-defined, the microcontroller 440 can use the defined sequences to modify the internal memory and reset or modify an output current and voltage limit dynamically.

An operation range programming confirming principle may now be described with respect to various embodiments of an LED driver as disclosed herein. It is desirable for many applications to test the programming after the microcontroller 440 adjusts the maximum output current and maximum output voltage values in order to confirm whether the programming was successful or not. A programming confirmation circuit 580 as illustrated in FIG. 5 may include a switching element Q2 connected between circuit ground and the negative dimming interface terminal V_ctl+. A digital signal input TXD is coupled between the microcontroller 440 and the gate electrode of the switching element Q2 via resistor R8. If the switching element Q2 is turned on by the TXD signal, the V_ctl+ will be shorted to circuit ground. If the switching element Q2 is off, the V_ctl+ will be pulled high. The digital signal TXD may comprise an internal confirmation signal sent out by the microcontroller 440 to the programming confirmation circuit 570 in order to generate a confirmation signal in the form of V_ctl+ being pulled low, which can be picked up by the programmer 460 to be used to confirm the success of the programming steps (or lack thereof).

Figure 8:
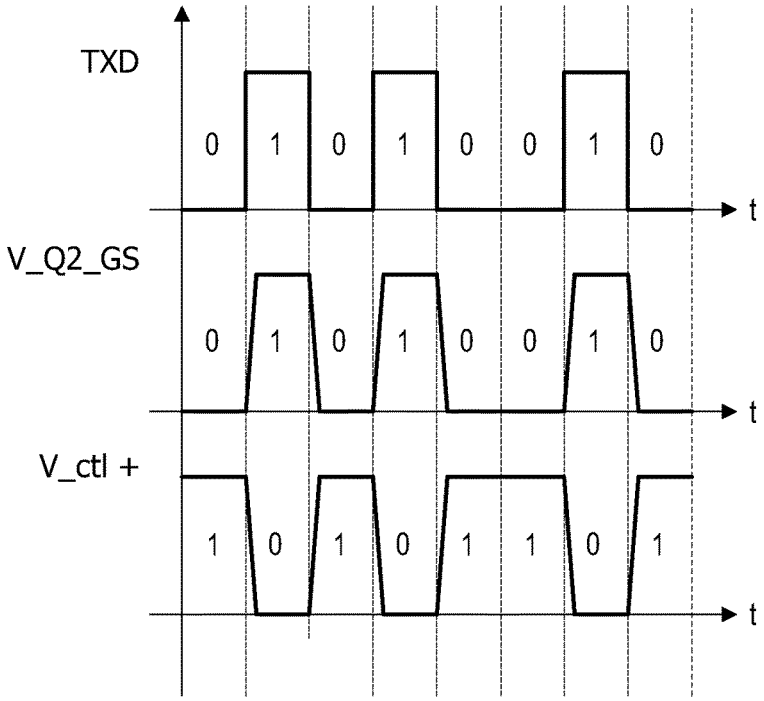
FIG. 8 is a graphical plot representing an exemplary working principle of a tuning confirmation circuit according to the LED driver of FIG. 5.

Operation of the programming confirmation circuit 580 may be further described with reference to FIG. 8. As previously noted, when the digital input signal TXD is low (0), the gate-source voltage V_Q2_GS for the switching element Q2 is also low (0), wherein the switching element Q2 is turned off and V_ctl+ is pulled high (1). Likewise, when the digital input signal TXD is high (1), the gate-source voltage V_Q2_GS for the switching element Q2 is also high, wherein the switching element Q2 is turned on and V_ctl is shorted to circuit ground, i.e., pulled low (0).

Figure 9:
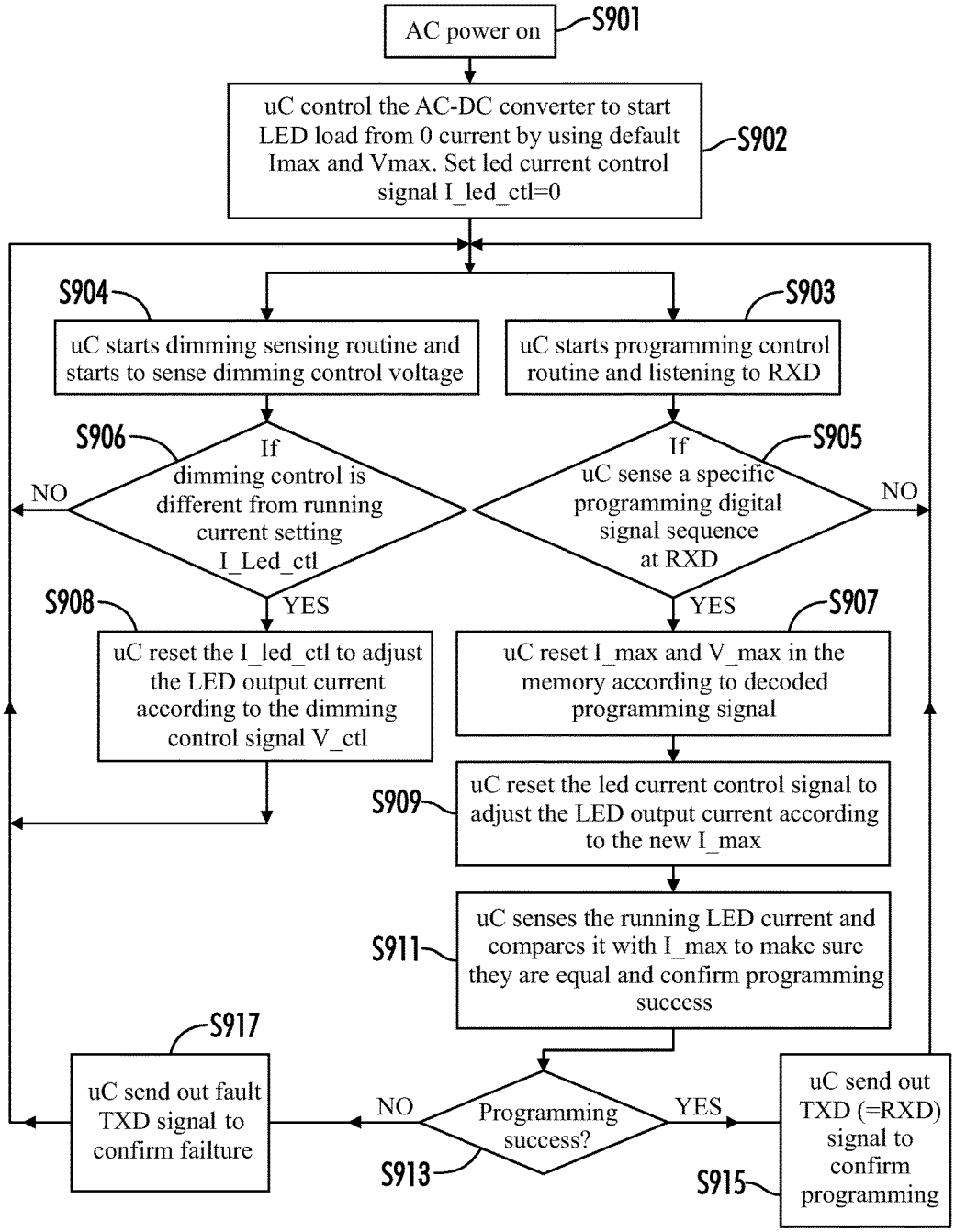
FIG. 9 is a flowchart representing an exemplary control method according to the present disclosure.

With further reference to FIG. 9, if programming has been successful, a series of digital signals (e.g., the same as the programming signals RXD received by the microcontroller 440) can be sent out by the controller via RXD to generate a confirmation signal across V_ctl+ and V_ctl−, with the confirming signal V_ctl+ being reversed as compared to TXD. The programmer 460 can reverse the confirmation signal and compare it with the programming signal in order to confirm if programming is successful or not. In various embodiments, the programmer 460 may be provided with a green light (e.g., LED or an equivalent) associated with the programmer 460 to indicate a programming status (e.g., as successful or unsuccessful), and may further comprise a second (e.g., red or other color) light used to indicate programming failure.

As illustrated at FIG. 9, in one exemplary embodiment, a method corresponding to the use of the LED driver 400 may begin at step S901 by powering on an AC power source. At step S902, a controller (e.g., microcontroller 440) may control an AC-DC converter to start an LED load from zero current by using a default maximum current and/or voltage. The microcontroller may set an LED current control signal I_led_ctl to zero for initial operation. The microcontroller may begin a dimming sensing routing and start sensing a dimming control voltage at step S904. The microcontroller may also begin a programming control routing and listening to an RXD signal, either simultaneously or at a separate time from step S904, at step S903.

It may be determined at step S906 whether dimming control is different from a running current setting I_led_ctl. If the determination is negative, the process flow may continue to steps S904 and S905. If the determination at step S906 is positive, the microprocessor at step S908 may reset the I_led_ctl value to adjust the LED output current according to a dimming control signal V_ctl.

At step S905, it may be determined if the microcontroller senses a specific programming digital signal sequence at RXD. If the result of step S905 is no, process flow may return to steps S903 and S904. If the result of step S905 is positive, the process may continue to step S907, where the microcontroller may reset a maximum voltage and/or current in a memory, in accordance with a decoded programming signal. The microprocessor may reset and/or manipulate an LED current control signal to adjust the LED output current according to a new maximum current at step S909. After setting the LED current control signal at step S909, the microcontroller may sense a running LED current and compare it with a maximum current value to ensure the values are equal and to confirm programming success at step S911. Step S913 may be used to determine whether programming was successful. If successful, the microprocessor at step S915 may send out a TXD signal (which is equal to RXD) to confirm programming and the process flow may return to steps S903/904. If the programming is not successful, the microprocessor at step S917 may send out a fault TXD signal to confirm a programming failure. The process flow may then return to steps S903/904.

Figure 10:
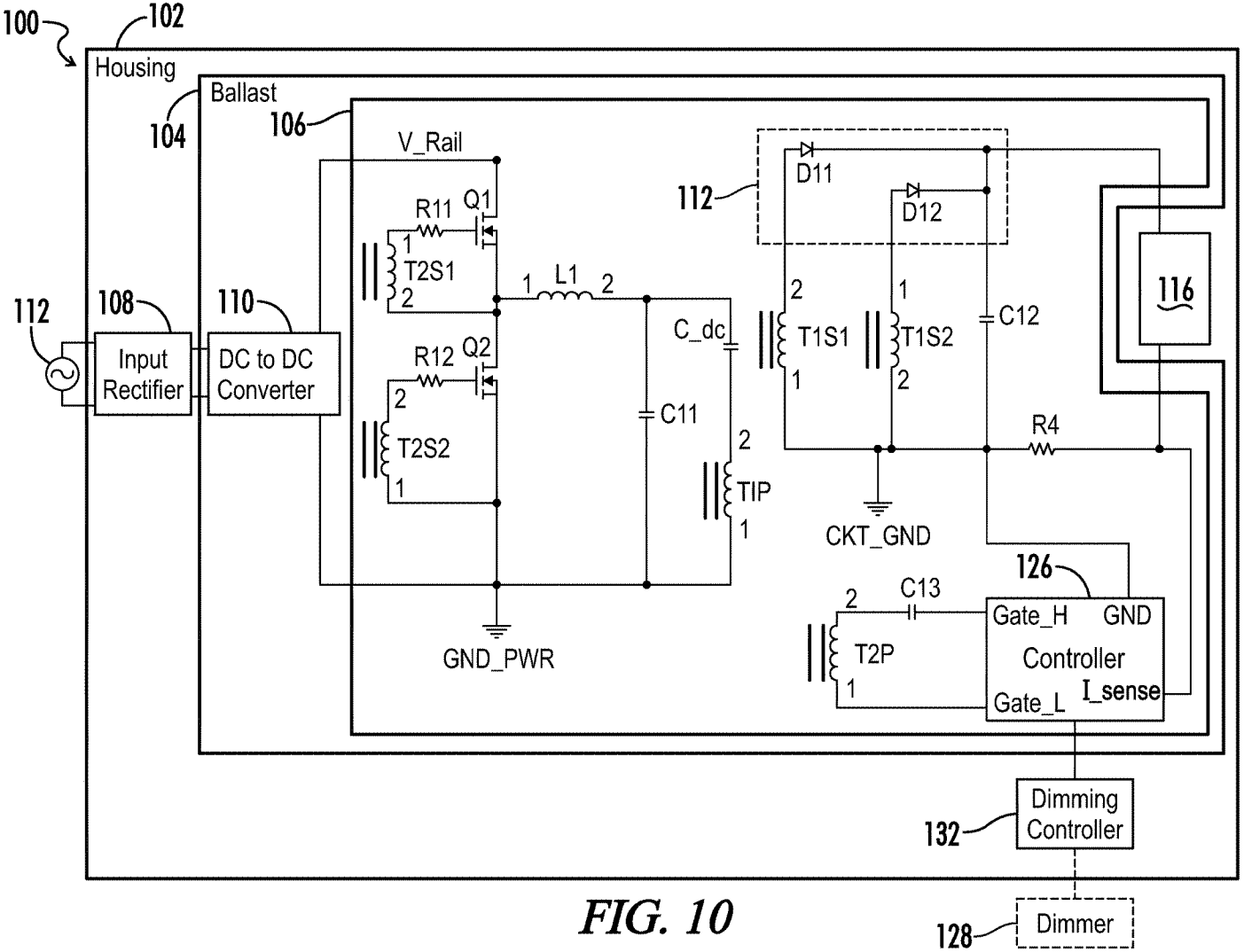
FIG. 10 is a block diagram and partial schematic diagram representing an exemplary embodiment of a light fixture having an LED driver according to the present disclosure.

FIG. 10 further illustrates an example of a light fixture 100 with an embodiment of the LED driver as disclosed herein. While FIG. 10 may provide a more detailed recitation of an exemplary power converter, for example, with respect to the LED driver of the present disclosure, the description provided below is not intended as limiting in any way on the scope of the present invention.

The exemplary light fixture 100 includes a housing 102, a ballast 106 and an LED array 116 as a light source. The light fixture 100 receives power from an alternating current (AC) power source 112 and provides current to the LED array 116. The housing 102 is connected to the ballast 106 and the light source 116, and in one embodiment may support the ballast 106 and the light source 116 in a predetermined spatial relationship. The light fixture 100 also includes a dimming circuit 132 operable to provide a dimming signal to the controller 126 which is indicative of a target current or light intensity level for the light source 116.

The ballast 106 includes an input rectifier 108 and a driver circuit 104. The input rectifier 108 is operable to connect to the AC power source 112 and provide a DC power source having a power rail V_RAIL and a ground GND_PWR at an output of the input rectifier 108. In one embodiment, the ballast 106 also includes a DC-to-DC converter 110 connected between the input rectifier 108 and the driver circuit 104. The DC-to-DC converter 110 is operable to alter a voltage of a power rail V_RAIL of a DC power source provided by the input rectifier 108. The driver circuit 104 is operable to provide current to the light source 116 from the DC power source provided by the input rectifier 108.

The driver circuit 104 includes a half-bridge inverter, a resonant tank circuit, an isolating transformer T1, an output rectifier 112, and the controller 120. The half-bridge inverter includes a first switch Q1 (i.e., a high side switch) and a second switch Q2 (i.e., a low side switch) and has an input connected to the power rail V_RAIL and the ground PWR_GND of the DC power source, and an AC signal output. In one embodiment, the input of the half-bridge inverter is a high side of the high side switch, and a low side of the low side switch (e.g., second switch Q2) is operable to connect to the ground of the DC power source.

The resonant tank circuit includes at least a resonant inductor L1 and a resonant capacitor C1. An input of the resonant tank circuit (e.g., a first terminal of a resonant inductor L1) is connected to the output of the half-bridge inverter. The resonant capacitor C1 is connected in series with the resonant inductor L1 between the output of the half-bridge inverter and the ground GND_PWR of the DC power source. In one embodiment, the resonant tank circuit includes a DC blocking capacitor C_DC connected between the junction of the resonant inductor L1 and resonant capacitor C1 and the output of the resonant tank circuit.

An isolating transformer is connected to the output of the resonant tank circuit. The isolating transformer includes a primary winding T1P and a secondary winding T1S1, T1S2. The primary winding T1P is connected between the output of the resonant tank circuit and the ground PWR_GND of the DC power source. The output rectifier 112 has an input connected to the secondary winding T1S1, T1S2 of the isolating transformer and an output operable to connect to the light source 116. In one embodiment, the turns ratio of the isolating transformer is selected as a function of a voltage of the power rail V_RAIL of the DC power source and a predetermined output voltage limit. In one embodiment, the output voltage limit is 60 VDC.

In one embodiment, the secondary winding T1S1, T1S2 of the isolating transformer is connected to a circuit ground CKT_GND which is isolated from the ground PWR_GND of the DC power source by the isolating transformer. Specifically, the secondary winding includes first secondary winding T1S1 and second secondary winding T152, each connected to the circuit ground CKT_GND. The first secondary winding T1S1 and the second secondary winding T152 are connected out of phase with one another.

The output rectifier includes a first output diode D11 and a second output diode D12. The first output diode D3 has its anode connected to the first secondary winding T1S1 and a cathode coupled to the light source 116 (i.e., an output of the driver circuit 104 and ballast 106). The second output diode D12 has an anode connected to the second secondary winding T152 and a cathode coupled to the light source 116 (i.e., the output of the driver circuit 104 and ballast 106).

In one embodiment, an output capacitor C2 is connected between the output of the output rectifier 116 and the circuit ground CKT_GND to smooth or stabilize the output voltage of the driver circuit 104 and ballast 106. In one embodiment, a current sensing resistor R4 is connected between the circuit ground CKT_GND and the light source 116. A first terminal of the current sensing resistor R4 is connected to the circuit ground CKT_GND, and a second terminal of the current sensing resistor is operable to connect to the light source 116. Thus, a voltage across the current sensing resistor is proportional to a current through the light source 116. The controller 126 is connected to the circuit ground CKT_GND and the second terminal of the current sensing resistor R4 to monitor the voltage across the current sensing resistor and sense the current provided to the light source 116 by the ballast 106.

In one embodiment, the driver circuit 112 further includes a gate drive transformer. The gate drive transformer is operable to receive the gate drive signal from the controller 126 which controls the switching frequency of the half-bridge inverter. The gate drive transformer includes a primary winding T2P a first secondary winding T2S1, and a second secondary winding T2S2. In this embodiment, the first switch Q1 and the second switch Q2 of the half-bridge inverter each have a high terminal, a low terminal, and a control terminal. The high terminal of the first switch Q1 is connected to the power rail V_RAIL of the DC power source. The low terminal of the second switch Q2 is connected to the ground PWR_GND of the DC power source. The high terminal of the second switch Q2 is connected to the low terminal of the first switch Q1. A gate drive capacitor C13 is connected in series with the primary winding T2P of the gate drive transformer across a gate drive output (i.e., gate_H and gate_L) of the controller 126. A first gate drive resistor R11 is connected in series with the first secondary winding T2S1 of the gate drive transformer between the control terminal of the first switch Q1 and the output of the half-bridge inverter. A second gate drive resistor R12 is connected in series with the second secondary winding T2S2 of the gate drive transformer between the control terminal of the second switch Q2 and the ground PWR_GND of the DC power circuit. The polarity of the first secondary winding T2S1 and the second secondary winding T2S2 of the gate drive transformer are opposites such that the first switch Q1 and the second switch Q2 are driven out of phase by the gate drive transformer.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An LED driver circuit permitting dynamic operation range control for powering an LED array, the LED driver comprising:

a power converter configured to generate an output voltage and an output current for driving the LED array;

a dimming interface circuit configured to generate a dimming control signal based on an input received across first and second dimming input terminals;

a tuning interface circuit configured to removably couple to the first and second dimming input terminals and to provide a programming signal associated with at least one of the output voltage and the output current;

a controller configured to regulate the output voltage and the output current generated by the power converter, based on the dimming control signal, a sensed output from the power converter, and at least one of a programmed maximum output voltage and a maximum output current value associated with the power converter, the dimming interface circuit, and the tuning interface circuit; and a tuning interface sensing circuit, the tuning interface sensing circuit comprising first and second capacitors coupled in series between the first dimming input terminal and a circuit ground, and a switching element having its gate electrode coupled to a node between the first and second capacitors, wherein a tuning input voltage corresponding to a high (1) digital pulse received via the tuning interface circuit is configured to charge the second capacitor and to turn on the switching element.

2. The LED driver circuit of claim 1, wherein the LED driver circuit further comprises a programming sensing circuit, wherein the controller is configured to modify at least one of the programmed maximum output voltage and the maximum output current values based on a predetermined sequence of digital pulses received via the tuning interface circuit at the programming sensing circuit.

3. The LED driver circuit of claim 1, further comprising:

a programming sensing circuit configured to sense a change in state associated with the tuning interface circuit, wherein the controller is configured to modify a maximum output current or a maximum output voltage associated with the power converter responsive to the sensed change in state associated with the tuning interface circuit.

4. The LED driver circuit of claim 3, wherein the programming sensing circuit is configured to receive an input signal from the tuning interface circuit and to generate a series signal which is conveyed to the controller for modifying at least one of the programmed maximum output current and the programmed maximum output voltage.

5. The LED driver circuit of claim 1, wherein the dimming interface circuit comprises a dimming controller coupled to the first and second dimming input terminals and to a circuit ground, and a resistance between the first dimming input terminal and the circuit ground.

6. The LED driver of claim 1, wherein the controller is configured to provide constant output power control associated with the power converter.

7. The LED driver of claim 1, wherein the controller is configured to identify a target maximum output voltage based on a predetermined sequence of digital pulses received via the tuning interface circuit, and is further configured to modify the programmed maximum output current and the programmed maximum output voltage based on the identified target maximum output voltage and a programmed constant power for the power converter.

8. The LED driver of claim 1, wherein the controller is configured to identify a target maximum output current based on a predetermined sequence of digital pulses received via the tuning interface circuit, and is further configured to modify the programmed maximum output current and the programmed maximum output voltage based on the identified target maximum output current and a programmed constant power for the power converter.

9. An LED driver circuit permitting dynamic operation range control for powering an LED array, the LED driver comprising:

a power converter configured to generate an output voltage and an output current for driving the LED array;

a dimming interface circuit configured to generate a dimming control signal based on an input received across first and second dimming input terminals;

a tuning interface circuit configured to removably couple to the first and second dimming input terminals and to provide a programming signal associated with at least one of the output voltage and the output current;

a controller configured to regulate the output voltage and the output current generated by the power converter, based on the dimming control signal, a sensed output from the power converter, and at least one of a programmed maximum output voltage and a maximum output current value associated with the power converter, the dimming interface circuit, and the tuning interface circuit;

wherein the LED driver circuit further comprises a programming sensing circuit, wherein the controller is configured to modify at least one of the programmed maximum output voltage and the maximum output current values based on a predetermined sequence of digital pulses received via the tuning interface circuit at the programming sensing circuit; and a tuning confirmation circuit coupled to the first dimming input terminal and configured to short the first dimming input terminal to circuit ground in response to a predetermined sequence of digital pulses received from the controller and corresponding to the predetermined sequence of digital pulses received by the controller from the programming sensing circuit.

10. A method of permitting dynamic operation range control for an LED driver circuit comprising a power converter configured to generate an output voltage and an output current, a dimming interface circuit having first and second input terminals, and a controller configured to regulate operation of the power converter based on a dimming control signal, a sensed output from the power converter, and at least one of a programmed maximum output voltage and a programmed maximum output current value associated with the power converter, dimming interface circuit, a tuning interface circuit, and the controller, the method comprising:

coupling the tuning interface circuit across the first and second input terminals of the dimming interface circuit;

generating a predetermined sequence of digital pulses from the tuning interface circuit, the sequence of digital pulses corresponding to at least one of a target maximum output voltage and a target maximum output current;

decoding the sequence of digital pulses to identify the target values;

modifying at least one of the programmed maximum output voltage and the programmed maximum output current values to correspond to at least one of the target maximum output voltage and the target maximum output current value; and transmitting a responsive sequence of digital signals to a control electrode of a tuning confirmation switching element, the responsive sequence of digital signals corresponding to at least one of the modified maximum voltage output value and the modified maximum current output value.

11. The method of claim 10, further comprising:

receiving the predetermined sequence of digital pulses from the tuning interface circuit at a programming sensing circuit of the LED driver;

transmitting the predetermined sequence of digital pulses to the controller; and modifying at least one of the programmed maximum output voltage and the maximum output current values based on the predetermined sequence of digital pulses by the controller.

12. The method of claim 10, further comprising comparing the responsive sequence of digital signals to an expected sequence of digital signals, wherein success or failure in modification of at least one of the maximum voltage output value and the maximum current output value is determined.

13. The method of claim 10, wherein decoding the sequence of digital pulses to identify the target values comprises identifying a target maximum output voltage based on the sequence of digital pulses received, and further identifying a target maximum output current based on the target maximum output voltage and a programmed constant power for the power converter.

14. The method of claim 10, wherein decoding the sequence of digital pulses to identify the target values comprises identifying a target maximum output current based on the sequence of digital pulses received, and further identifying a target maximum output voltage based on the target maximum output current and a programmed constant power for the power converter.

15. A method of permitting dynamic operation range control for a light fixture, the light fixture comprising an AC-DC power converter configured to couple to an AC power source, an LED array coupled across first and second outputs from the AC-DC power converter, a dimming interface circuit having first and second input terminals, and a controller configured to regulate operation of the power converter based on a dimming control signal, a sensed output from the power converter, and at least one of a programmed maximum output voltage value and a maximum output current value, the method comprising:

coupling a programming interface circuit across the first and second input terminals of the dimming interface circuit;

generating a predetermined sequence of digital pulses from the programming interface circuit, the sequence of digital pulses corresponding to at least one of a target maximum output voltage and a target maximum output current;

decoding the sequence of digital pulses to identify at least one of the target maximum output voltage and the target maximum output current values;

modifying at least one of the programmed maximum output voltage and the programmed maximum output current values to correspond to at least one of the target maximum output voltage and the target maximum output current values;

transmitting a responsive sequence of digital signals to a control electrode of a programming confirmation switching element, the responsive sequence of digital signals corresponding to at least one of the modified maximum voltage output and the modified maximum current output values; and comparing the responsive sequence of digital signals to an expected sequence of digital signals, wherein success or failure in modification of at least one of the maximum voltage output and the maximum current output values is determined.

16. The method of claim 15, wherein the AC-DC converter comprises an input rectifier operable to connect to the AC power source and provide a direct current (DC) power source having a power rail and a ground at an output of the input rectifier, an inverter having an input and an output, wherein the input is operable to connect to the power rail and the ground of the DC power source and provide an AC signal at the output, a resonant tank circuit having an input connected to the output of the inverter and an output, the resonant tank circuit comprising a resonant inductor and a resonant capacitor connected in series with the resonant inductor between the output of the inverter and the ground of the DC power source, an isolating transformer connected to the output of the resonant tank circuit, the isolating transformer comprising a primary winding connected between the output of the resonant tank circuit and the ground of the DC power source, and a secondary winding; and an output rectifier having an input connected to the secondary winding of the isolating transformer and an output operable to connect to the LED array.

17. The method of claim 15, wherein decoding the sequence of digital comprises identifying a target maximum output voltage based on the sequence of digital pulses received, and further identifying a target maximum output current based on at least one of the target maximum output voltage and a programmed constant power for the power converter.

18. The method of claim 15, wherein decoding the sequence of digital pulses comprises identifying a target maximum output current based on the sequence of digital pulses received, and further identifying a target maximum output voltage based on at least one of the target maximum output current and a programmed constant power for the power converter.

* * * * *